US006652617B2

(12) United States Patent
Maili et al.

(10) Patent No.: US 6,652,617 B2
(45) Date of Patent: Nov. 25, 2003

(54) PM HIGH-SPEED STEEL HAVING HIGH ELEVATED-TEMPERATURE STRENGTH

(75) Inventors: Ingrid Maili, Bruck a.d. Mur (AT); Roland Rabitsch, Schladming (AT); Werner Liebfahrt, Kapfenberg (AT)

(73) Assignee: Böhler Edelstahl GmbH, Kapfenberg (AT)

( * ) Notice: Subject to any disclaimer, the term of this patent is extended or adjusted under 35 U.S.C. 154(b) by 0 days.

(21) Appl. No.: 10/096,257

(22) Filed: Mar. 13, 2002

(65) Prior Publication Data

US 2003/0095886 A1 May 22, 2003

(30) Foreign Application Priority Data

Apr. 11, 2001 (AT) ..... 586/2001

(51) Int. Cl.[7] ..... C22C 33/02

(52) U.S. Cl. ..... 75/243; 75/246; 419/11; 419/28; 419/29

(58) Field of Search ..... 75/246, 243; 419/11, 419/28, 49

(56) References Cited

U.S. PATENT DOCUMENTS 3,936,299 A * 2/1976 Steven ..... 419/48
4,224,060 A * 9/1980 de Souza et al. ..... 420/100
4,599,109 A * 7/1986 Kawai et al. ..... 75/238
4,880,461 A * 11/1989 Uchida ..... 75/238
5,252,119 A * 10/1993 Nishida et al. ..... 75/236
6,180,266 B1 * 1/2001 Amano et al. ..... 428/681
6,482,354 B1 * 11/2002 Wert et al. ..... 420/10

OTHER PUBLICATIONS

German Industrial Standard DIN 50 602, Sep. 1985.

Zeitschrift für Metallkunde 90 (1999) 8, Carl Hanser Verlag, Müchen, pp. 637–643.

* cited by examiner

*Primary Examiner*—Ngoclan Mai
(74) *Attorney, Agent, or Firm*—Greenblum & Bernstein, P.L.C.

(57) ABSTRACT

A high-speed steel article, particularly a cutting tool, produced by powder metallurgy and its production, the steel having a high degree of purity corresponding to a K0 value of no higher than 3 according to DIN 50 602 and being of a particular composition which comprises the elements C, Si, Mn, Cr, W, Mo, V, Co, S and N. Also provided is a process for the high-speed machining of metal parts without lubricants.

32 Claims, 3 Drawing Sheets

PM HIGH-SPEED STEEL HAVING HIGH ELEVATED-TEMPERATURE STRENGTH

CROSS-REFERENCE TO RELATED APPLICATIONS

The present application claims priority under 35 U.S.C. §119 of Austrian Patent Application No. 586/2001, filed Apr. 11, 2001 the disclosure of which is expressly incorporated by reference herein in its entirety.

BACKGROUND OF THE INVENTION

1. Field of the Invention

The present invention relates to a high-speed steel article which has high elevated-temperature strength and toughness and is produced by powder metallurgy by dispersing a liquid stream of an alloy with nitrogen into a metal powder and compacting the powder at high temperature under compression from all sides and optionally is hot worked thereafter.

2. Discussion of Background Information

High-performance high-speed steels include alloys with about 0.8 to 1.0% by weight of carbon, 14 to 18% by weight of tungsten, about 4.5% by weight of chromium, up to 2% by weight of molybdenum, at least 1.2 to 1.5% by weight of molybdenum, at least 1.2 to 1.5% by weight of vanadium, and 3 to 20% by weight of cobalt, the remainder being iron. The cause of the high performance that is achievable with these high-speed steels lies in the interaction of the strongly carbide-forming elements vanadium, tungsten, molybdenum and chromium, and the element cobalt, which acts through the basis mass or matrix. Along with tungsten and molybdenum, vanadium in particular is suited to provide the alloy with a high tempering resistance up to a temperature of about 600° C. When high carbon content and high vanadium content are present at the same time, a large quantity of vanadium carbides is also formed, which results in a particularly high wear resistance of the material. For this reason, finishing tools in particular are made of high-speed steels that have elevated carbon and vanadium content. However, the limits of economical manufacturability through pyrometallurgical or casting methods with solidification in casting molds appear to be reached when an alloy with the chemical composition in percent by weight of 1.3 to 1.5 C, about 13 W, 4 Cr, 1 Mo, 8 to 12 Co and about 4.5 V, remainder iron, is used. Due to its high carbon content and its solidification structure even this material is workable only with difficulty and at a lowered, narrow forging temperature range and shows only low toughness values, in particular low impact bending strength, in the tempered state.

In order to be able to further increase the carbon content and the concentration of carbide-forming elements for increasing the carbide content and thus further increasing the wear resistance of the material on the one hand, while on the other hand achieving adequate workability and homogeneity of the article manufactured therefrom, powder metallurgy production of such alloyed parts is advantageous.

Powder metallurgy (PM) production essentially comprises atomization of a steel melt into metal powder, introduction and compression of the metal powder into a capsule, closing the capsule, and heating and hot isostatic pressing of the powder in the capsule into a dense, homogeneous material.

This PM material can be used to manufacture articles directly after an appropriate heat treatment, or can first be subjected to hot working, for example by forging.

Highly stressed high-speed steel articles, in particular cutting tools with a long service life, require a diverse property profile for an economic processing of parts.

SUMMARY OF THE INVENTION

The present invention provides a high-speed steel article, preferably for use in a high-performance cutting tool, which has a high degree of oxide purity and hence offers a low crack initiation potential and an increased degree of cutting edge sharpness, and possesses high hardness with commensurate toughness and high wear resistance in the tempered state of the material as well as improved hot hardness and elevated-temperature strength.

The present invention also provides a high-speed steel article suitable for use as a tool for the high-speed machining of materials without the use of lubricants, in particular for metal-cutting machining of light metals and corresponding alloys.

In accordance with the present invention there is provided a high-speed steel article of the aforementioned type which has a high degree of purity with a content and configuration of nonmetallic inclusions corresponding to a K0 value according to DIN 50 602, which is hereby fully incorporated herein by reference, of at most 3 and has the following chemical composition in percent by weight (as used in the present specification and the appended claims, all weight percentages are based on the total weight of the composition):

| | |
|---|---|
| carbon (C) | 1.51 to 2.5 |
| silicon (Si) | >0 to 0.8 |
| manganese (Mn) | >0 to 1.5 |
| chromium (Cr) | 3.5 to 4.5 |
| tungsten (W) | 13.3 to 15.3 |
| molybdenum (Mo) | 2.0 to 3.0 |
| vanadium (V) | 4.5 to 6.9 |
| cobalt (Co) | 10.05 to 12.0 |
| sulfur (S) | >0 to 0.52 |
| nitrogen (N) | >0 to 0.3 |
| oxygen (N) | max 100 ppm |

with a value of manganese minus sulfur (Mn−S) of at least 0.19, the remainder being iron and impurities related to the manufacturing process and accompanying elements, provided that the concentration ratio of tungsten and molybdenum (W/Mo) is between 5.2 and 6.5 and that the cobalt content is at most 70% of the value of (tungsten+molybdenum).

In one aspect of the steel article according to the invention, at least one or all of the following elements are present in the following concentration ranges in % by weight:

| | |
|---|---|
| C | 1.75 to 2.38 |
| Si | 0.35 to 0.75 |
| Mn | 0.28 to 0.54 |
| Cr | 3.56 to 4.25 |
| W | 13.90 to 14.95 |
| Mo | 2.10 to 2.89 |
| V | 4.65 to 5.95 |
| Co | 10.55 to 11.64 |
| N | 0.018 to 0.195. |

In another aspect, at least one or all of the following elements are present in the following concentration ranges in % by weight:

| | |
|---|---|
| C | 1.69 to 2.29 |
| Si | 0.20 to 0.60 |
| Mn | 0.20 to 0.40 |
| Cr | 3.59 to 4.19 |
| W | 13.60 to 14.60 |
| Mo | 2.01 to 2.80 |
| V | 4.55 to 5.45 |
| Co | 10.40 to 11.50 |
| N | 0.02 to 0.1 |
| O | max 90 ppm. |

In yet another aspect, the article is a tool, e.g., a finishing tool, a cutting tool or a metal-cutting tool.

The present invention further provides a process for making a high-speed steel article by powder metallurgy, wherein the composition of the steel is as indicated above, including the various aspects thereof, said process comprising dispersing a liquid stream of the steel with nitrogen into a metal powder and compacting the powder at high temperature under compression from all sides (e.g., by hot isostatic pressing).

In one aspect, the process further comprises hot working of the compacted and compressed metal powder, e.g., by forging. In another aspect of the process, the article is a tool.

Furthermore, the present invention provides a process for the high-speed machining of material parts. The process comprises machining the material parts without lubricants with a powder metallurgy produced tool made of a high-speed steel. This steel has the composition indicated above.

According to one aspect of the process, the parts are made of metal, e.g., light metal or a corresponding alloy.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

sample geometry: half disks Rd 30×10 mm
austenitizing in vacuum at 1210° C.
quenching in nitrogen stream
tempering: 3×2 hours.

Figure 1:
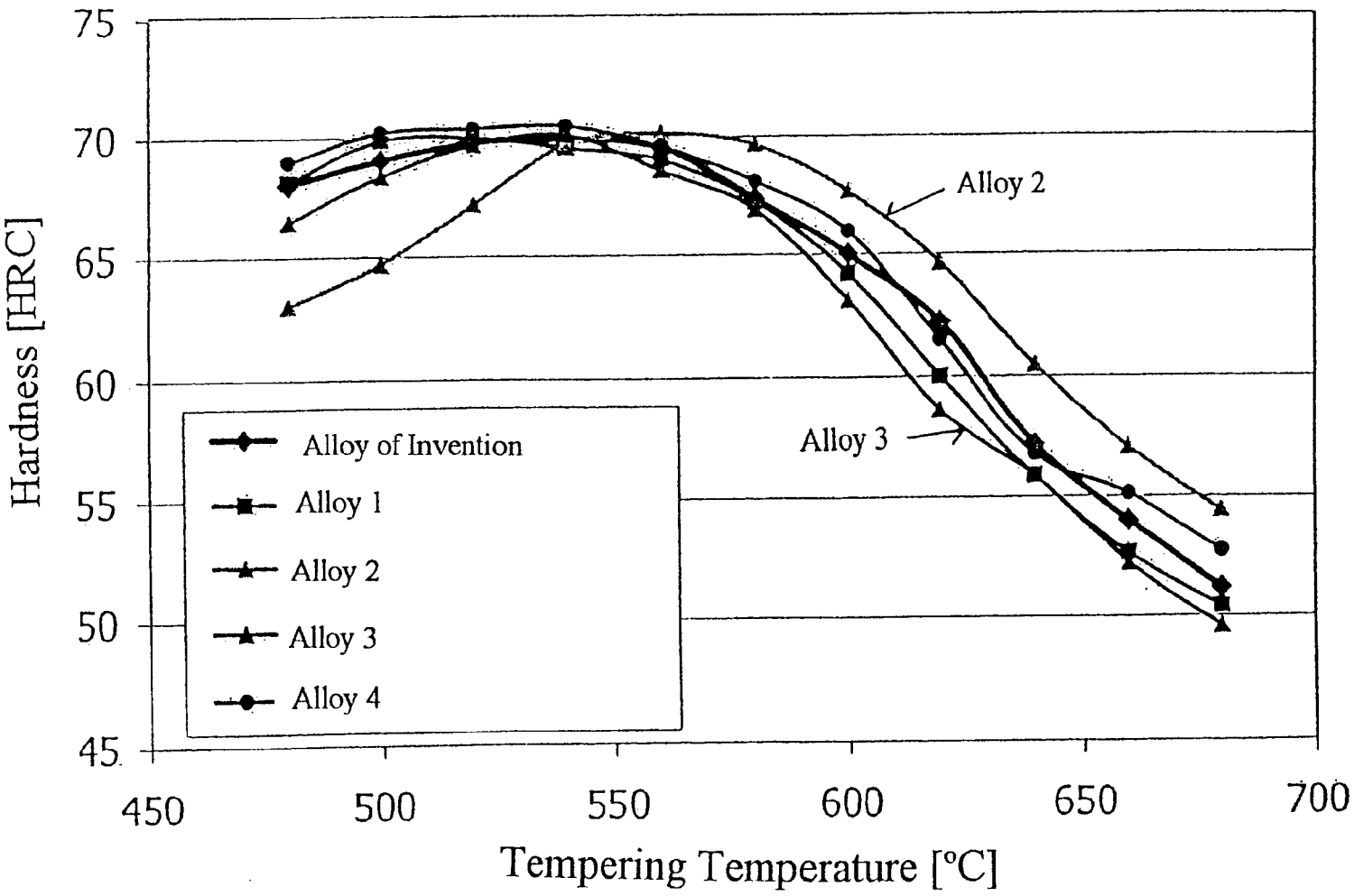
FIG. 1 shows the tempering curves of test materials. The sample geometry and the heat treatment conditions were as follows.
Figure 2:
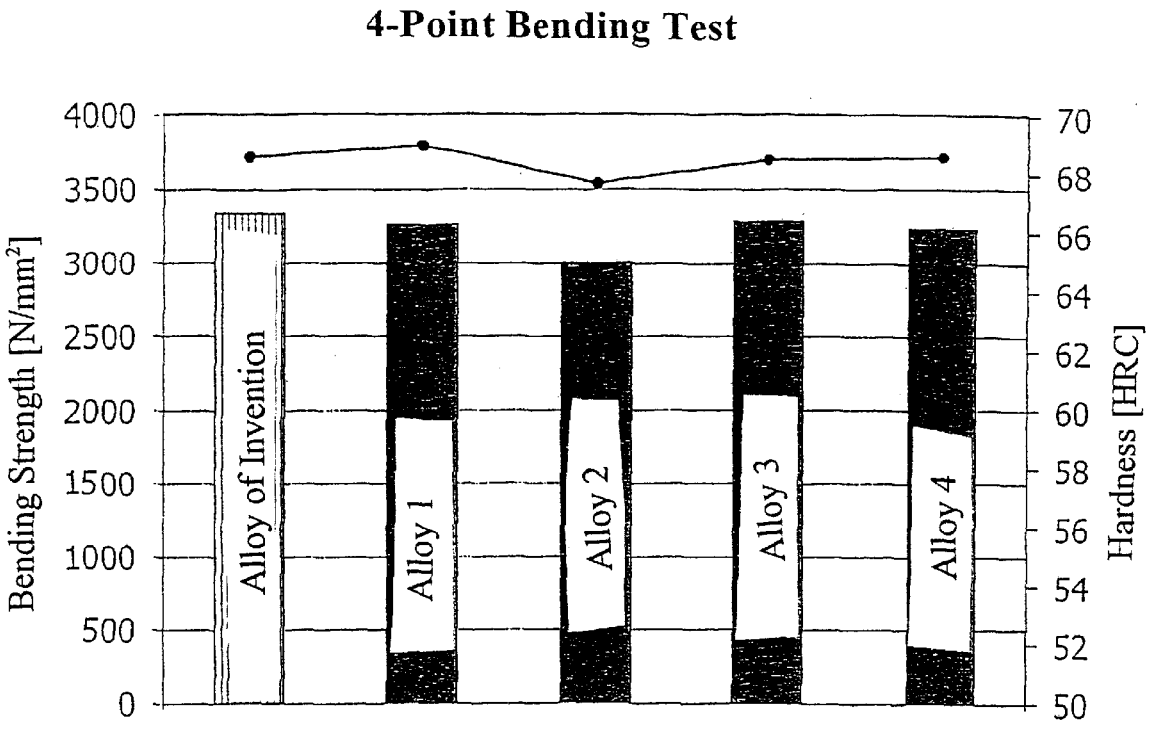
Figure 2A:
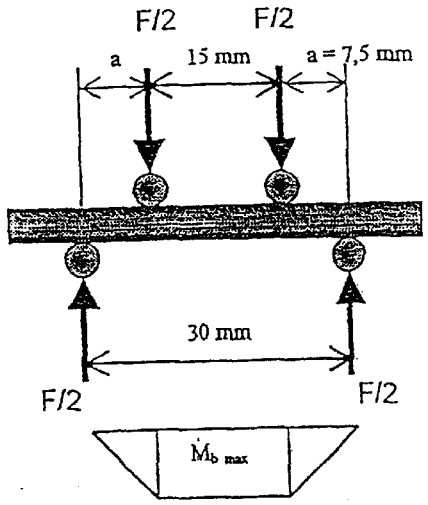

FIG. 2 shows comparisons of the bending strengths of the test materials of FIG. 1 in the 4-point bending test with the following sample data. Testing was done in accordance with the conditions illustrated in FIG. 2*a* and specified below.

Sample geometry:
round sample Rd 5.0 mm
hardened in vacuum at 1210° C.
tempering: 3×2 hours.

Figure 3:
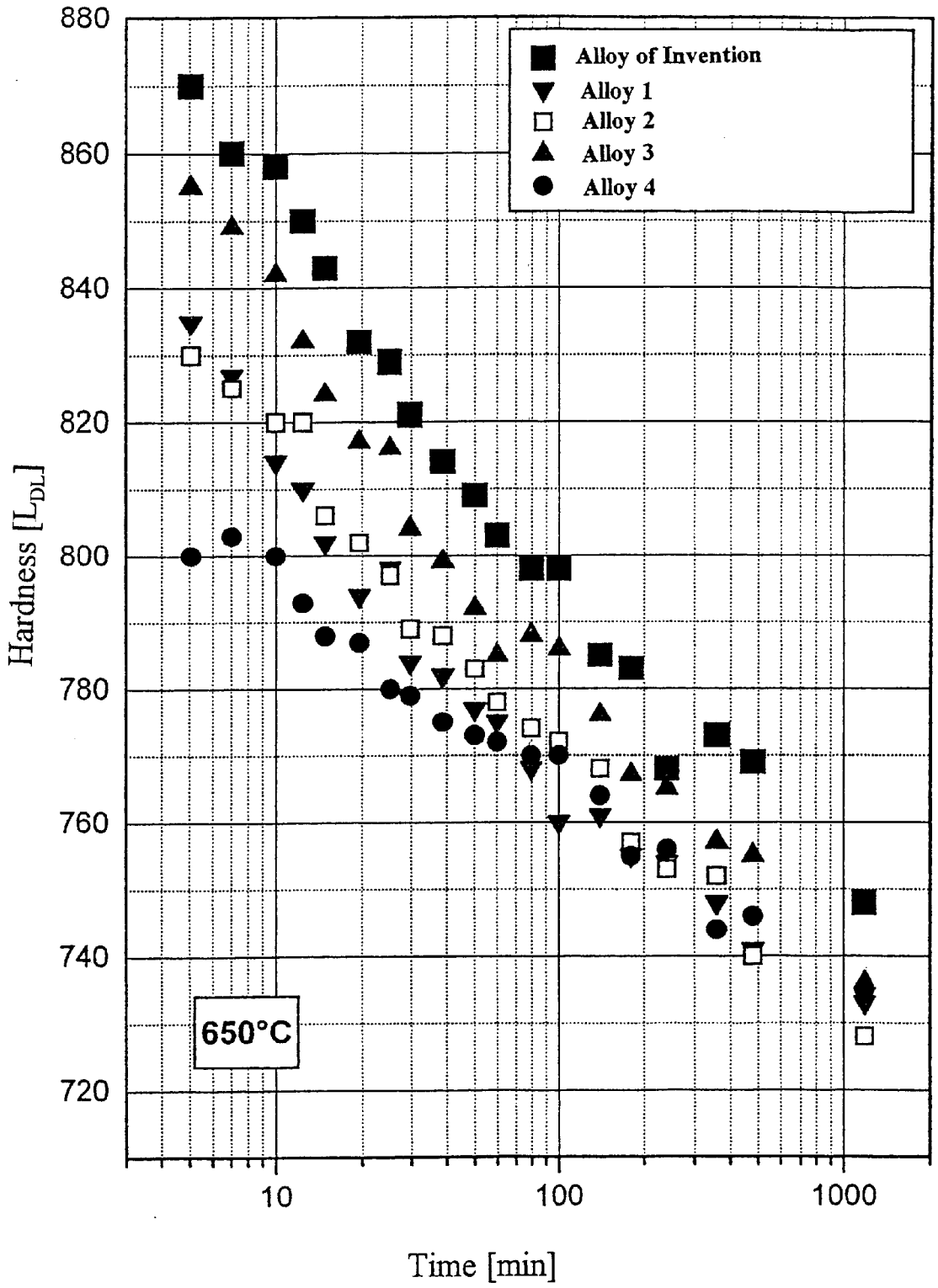

FIG. 3 shows the variation of hot hardness of the test materials of FIG. 1 at 650° C. as a logarithmic function of the time, with all samples having nearly the same starting hardness of 67 to 68 HRC (Rockwell Harness C). The hot hardness test was performed with a dynamic procedure developed by the Leoben Materials Competence Center (*Zeitschrift für Metallkunde* 90 (1999) 8, 637, which is hereby fully incorporated herein by reference).

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The advantages achieved with the article in accordance with the invention must be considered in terms of the combined effect with regard to the improvement of the material properties, just as in the vivid expression that a chain is only as strong as its weakest link. Oxide inclusions are defects with a generally edged structure. As has been found, above a critical size these oxide inclusions are the origins of cracks in material tempered to a high degree of hardness, with a state of stress, possibly alternating, therein. Crack initiation by coarse oxides in the material increases disproportionately in a matrix with high hot hardness or elevated-temperature strength. Yet, as has been demonstrated, inclusions that are small in diameter and short in length have little effect. In accordance with the present invention, a cumulative characteristic value of not higher than 3 in the test for nonmetallic inclusions according to the K0 method of DIN 50 602 has, thus, been found to be important.

The excellent profile of properties of the alloy in accordance with the invention is produced synergistically by the interaction of the elements in their respective activities. It is essential for the elements carbon, chromium, tungsten, molybdenum, vanadium and cobalt to be present in the high-speed steel within narrow concentration ranges and for the oxygen content not to exceed a maximum value. The carbon content must be considered in light of the high carbon affinity of tungsten, molybdenum and vanadium. The above alloy metals form stable primary carbides, however secondary hardness carbides are also incorporated according to interaction and respective activity in the matrix mixed crystals.

If the carbon concentration exceeds a value of about 2.5% by weight, a marked embrittlement of the high-speed steel material occurs, which can go as far as making the article, for example a cutting tool, unusable. Carbon contents of less than about 1.51% by weight reduce the proportion of carbides and critically reduce the wear resistance of the material. In accordance with the invention, the carbon content of the alloy is about 1.51 to about 2.5% by weight.

The reason for the maximum chromium concentration of about 4.5% by weight is that higher contents result in a chromium proportion in the matrix that has a stabilizing effect on the residual austenite content during hardening. Down to a minimum value of 3.5% by weight of chromium, the incorporation of the alloy atoms into the mixed crystals results in a desirable hardening thereof, so that a content range from about 3.5 to about 4.5% by weight in the material is provided in accordance with the invention.

Tungsten and molybdenum have a high carbon affinity, form nearly the same types of carbides, and, according to a widely held opinion in this field, are interchangeable at 2 to 1 on the basis of mass content because of their respective atomic weights. Surprisingly, it has been found that this interchangeability is not complete, but instead the mixed carbide formation and the proportion of the elements in the mixed crystal can be controlled by the respective activity of these alloy elements; this will be discussed in greater detail in the discussion of the elevated-temperature strength of the high-speed steel.

Vanadium is one of the strongest monocarbide-forming elements; its carbides are remarkable for their great hardness and are the basis of the special wear resistance of the material. The wear resistance is promoted by the fine formation and an essentially homogeneous distribution of the monocarbides as they are produced by powder metallurgical manufacture of the material. Vanadium in particular, but also tungsten and molybdenum, can be partially brought into solution at high temperatures, which after a forced cooling of the article yields a significant secondary hardness potential through the precipitation of extremely finely distributed vanadium-rich secondary carbides through tempering treatments, and has a beneficial effect on the elevated-temperature strength of the material. A vanadium content above about 6.9% by weight either necessitates a higher carbon content of the alloy, causing embrittlement thereof, or a depletion and a reduction in strength occurs, especially a reduction in the elevated-temperature strength of the matrix. Vanadium concentrations below about 4.5% by weight result in a significant deterioration of the wear characteristics of the tempered part.

In high-speed steel, cobalt is not a carbide-forming element, although it does strengthen the matrix and significantly promotes the thermal resistance of the article. High cobalt contents of more than about 12.0% by weight in the given high-speed steel have an embrittling effect on the basis mass of the material, whereas concentrations lower than about 10.05% by weight result in a distinct reduction in matrix hardness at elevated temperature.

Within the limits of about 10.05 to about 12.0% by weight provided according to the invention, cobalt has the effect, due to the high diffusions coefficients when the hardened part is tempered because of the increased nucleation, that the diffusion processes are facilitated and thus the secondary carbide precipitations are formed in large number and great quantity finely distributed, also coarsen only slowly and have an advantageous effect on the matrix strength, particularly at high temperatures.

The fine secondary carbides, which lend great hardness and strength to the material in the tempered state, are enlarged by diffusion processes at high application temperatures or a coagulation takes place. On account of a high tungsten content in the alloy and, consequently, in the secondary carbides, a smaller diffusion coefficient results relative to molybdenum and vanadium because of the size of the tungsten atoms, so that a significantly slower coarsening and stabilization of the system takes place at high temperatures, even with mixed carbides, as has been found. The proportion of tungsten in accordance with the invention of about 13.3 to about 15.3% by weight ensures, with the specified contents of the other strongly carbide-forming elements, a low tendency toward coarsening of the secondary hardening carbides at elevated temperatures and hence a small carbide particle spacing over the long term, which blocks displacements in the matrix lattice and dilates the softening of the material. Even under high thermal stresses the material remains hard longer, and thus has greater elevated-temperature strength.

Particular importance is attached to the molybdenum in reaction kinetics and mixed carbide formation, where in accordance with the present invention a content of about 2.0 to about 3.0% by weight has been determined to be effective.

A maximum oxygen content of about 100 ppm is provided for in consideration of the number of nonmetallic inclusions and the property profile of the material under the intended stresses.

Particularly important for a high elevated-temperature strength of the tempered material is the ratio of the concentrations of tungsten and molybdenum and the concentration of cobalt which is adjusted to these elements. At ratios of tungsten to molybdenum from about 5.2 to about 6.5, the rate of secondary carbide particle coarsening, and hence a decrease in the hardness of the material at high temperatures, is minimized, a content of less than about 70% cobalt relative to the concentration of (tungsten+molybdenum) effecting an increase in the nucleation sites for the formation of secondary carbides, thereby promoting a finely dispersed distribution of the same, which taken together ensures a high elevated-temperature strength of the high-speed steel object.

Although silicon in the alloy has a mixed crystal strengthening and deoxidizing effect, for reasons of the hardenability of the material the silicon content should not exceed about 0.8% by weight.

Although manganese can influence the hardening behavior of the material, it should be viewed primarily together with the sulfur content, where sulfur and manganese should be considered elements that improve the workability of the steel due to the formation of sulfide inclusions. With preferably low manganese contents in the steel, the value of (manganese minus sulfur) should not fall below about 0.19%, because otherwise hot forming problems and diminished material properties at high application temperatures may be caused.

Owing to the formation of carbonitrides that are poorly soluble at high temperatures in the material in accordance with the present invention, nitrogen can have a beneficial effect on the improvement in elevated-temperature strength, but should be alloyed up to a content of only about 0.2% by weight to avoid manufacturing problems.

In embodiments of the invention for further improving the application properties of the high-speed steel, the steel can have one or more elements with the following concentration values in % by weight, with the above composition being taken as a basis:

| | |
|---|---|
| C | 1.75 to 2.38 |
| Si | 0.35 to 0.75 |
| Mn | 0.28 to 0.54 |
| Cr | 3.56 to 4.25 |
| W | 13.90 to 14.95 |
| Mo | 2.10 to 2.89 |
| V | 4.65 to 5.95 |
| Co | 10.55 to 11.64 |
| N | 0.018 to 0.195 |

With such an element-specific limitation of the chemical composition, individual properties of the material can be especially promoted.

A further narrowing of the concentration range of alloy components can be used to advantage for the targeted development of materials for special application cases, wherein the article has one or more elements with the following concentration values in % by weight, based on the first-mentioned composition:

| | |
|---|---|
| C | 1.69 to 2.29 |
| Si | 0.20 to 0.60 |
| Mn | 0.20 to 0.40 |
| Cr | 3.59 to 4.19 |
| W | 13.60 to 14.60 |

-continued

| | |
|---|---|
| Mo | 2.01 to 2.80 |
| V | 4.55 to 5.45 |
| Co | 10.40 to 11.50 |
| N | 0.02 to 0.1 |
| O | max 90 ppm. |

According to the present invention, a high-speed steel cutting tool with high elevated-temperature strength and toughness that is produced by powder metallurgy by dispersing a liquid stream of an alloy with nitrogen into a metal powder and compacting the powder at elevated temperature under compression from all sides and optionally is hot worked, and that has a high degree of purity with a content and configuration of nonmetallic inclusions corresponding to a K0 value of no higher than 3 according to DIN 50 602 and has the following chemical composition in percent by weight:

| | |
|---|---|
| C | 1.51 to 2.5 |
| Si | >0 to 0.8 |
| Mn | >0 to 1.5 |
| Cr | 3.5 to 4.5 |
| W | 13.3 to 15.3 |
| Mo | 2.0 to 3.0 |
| V | 4.5 to 6.9 |
| Co | 10.05 to 12.0 |
| S | >0 to 0.52 |
| N | >0 to 0.2 |
| O | max 100 ppm |

with a value of manganese minus sulfur (Mn–S) of at least 0.19, the remainder being iron and impurities related to the manufacturing process and accompanying elements, provided that the concentration ratio of tungsten to molybdenum is 5.2 to 6.5 and that the cobalt content is at most 70% of the value of (tungsten+molybdenum), is suitable for the high-speed machining of material parts without lubricants, in particular parts made of light metals and corresponding alloys. With such requirements, it has been demonstrated that particularly large increases in service life under difficult conditions can be attained through the use of tools in accordance with the invention, which can produce, in particular, economic advantages in metal-cutting machining.

The chemical compositions of test materials, i.e., a high-speed steel article in accordance with the invention and comparison materials (see explanation of FIGS. 1–3 above) can be taken from Table 1.

It is evident from a comparison of the test results that the hardness/tempering curves (FIG. 1) of the different materials lie close together and that alloy 1 results in the highest hardness values at a tempering temperature above 570° C.

Even though the material in accordance with the invention does have the highest bending strength (FIG. 2), the differences with respect to the comparison materials are not pronounced.

Clear superiority of the article with a composition in accordance with the invention can be seen in a comparison of the hot hardness values of the high-speed steel materials (FIG. 3).

This high hot hardness and the particularly high degree of oxide purity of the material resulted in a 38% better service life of the cutting tool was observed in practical application in high-speed dry machining with interrupted cut of castings made of an aluminum-silicon alloy, wherein the wear was attributed primarily to increased accumulations of silicon in the Al—Si alloys.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

TABLE 1

| | Chemical Composition of the High-Speed Steel in Accordance with the Invention and the Comparison Alloys | | | | | | | | | | | |
|---|---|---|---|---|---|---|---|---|---|---|---|---|
| Composition % | C | W | Mo | V | Co | Si | Mn | S | N | O | Mn-S | W/Mo |
| Alloy 1 | 2.30 | 6.32 | 6.52 | 6.15 | 10.30 | 0.62 | 0.28 | 0.002 | 0.074 | 0.007 | 0.28 | 0.97 |
| Alloy 2 | 3.40 | 10.00 | 4.80 | 9.50 | 8.50 | 0.61 | 0.38 | 0.016 | 0.050 | 0.020 | 0.36 | 2.08 |
| Alloy 3 | 2.15 | 13.00 | 0.00 | 6.20 | 9.90 | 0.73 | 0.28 | 0.008 | 0.067 | 0.020 | 0.27 | / |
| Alloy 4 | 2.10 | 14.00 | 5.70 | 5.30 | 11.40 | 0.31 | 0.27 | 0.006 | 0.039 | 0.012 | 0.26 | 2.46 |
| Alloy of the invention | 2.00 | 14.30 | 2.50 | 5.00 | 11.00 | 0.40 | 0.30 | 0.018 | 0.050 | 0.007 | 0.28 | 5.72 |

What is claimed is:

1. A high-speed steel article produced by powder metallurgy, wherein the steel has a content and configuration of nonmetallic inclusions corresponding to a K0 value according to DIN 50 602 of not higher than 3 and has the following chemical composition in percent by weight:

| | |
|---|---|
| carbon (C) | 1.51 to 2.5 |
| silicon (Si) | >0 to 0.8 |
| manganese (Mn) | >0 to 1.5 |
| chromium (Cr) | 3.5 to 4.5 |
| tungsten (W) | 13.3 to 15.3 |
| molybdenum (Mo) | 2.0 to 3.0 |
| vanadium (V) | 4.5 to 6.9 |
| cobalt (Co) | 10.05 to 12.0 |
| sulfur (S) | >0 to 0.52 |

-continued

| | |
|---|---|
| nitrogen (N) | >0 to 0.2 |
| oxygen (O) | max 100 ppm |

with a value of manganese minus sulfur (Mn−S) of at least 0.19, the remainder being iron and impurities related to the manufacturing process and accompanying elements, provided that the ratio of tungsten to molybdenum (W/Mo) is between 5.2 and 6.5 and the cobalt content is at most 70% of the value of (W+Mo).

2. The high-speed steel article of claim 1, wherein the steel comprises 1.75 to 2.38% by weight of carbon.

3. The high-speed steel article of claim 2, wherein the steel comprises 0.35 to 0.75% by weight of silicon.

4. The high-speed steel article of claim 3, wherein the steel comprises 0.28 to 0.54% by weight of manganese.

5.The high-speed steel article of claim 3, wherein the steel comprises 3.56 to 4.25% by weight of chromium.

6. The high-speed steel article of claim 2, wherein the steel comprises 13.90 to 14.95% by weight of tungsten.

7. The high-speed steel article of claim 2, wherein the steel comprises 2.10 to 2.89% by weight of molybdenum.

8. The high-speed steel article of claim 2, wherein the steel comprises 4.65 to 5.95% by weight of vanadium.

9. The high-speed steel article of claim 5, wherein the steel comprises 10.55 to 11.64% by weight of cobalt.

10. The high-speed steel article of claim 9, wherein the steel comprises 0.018 to 0.195% by weight of nitrogen.

11. The high-speed steel article of claim 1, wherein at least one of the following elements is present in the following concentration ranges in % by weight:

| | |
|---|---|
| C | 1.75 to 2.38 |
| Si | 0.35 to 0.75 |
| Mn | 0.28 to 0.54 |
| Cr | 3.56 to 4.25 |
| W | 13.90 to 14.95 |
| Mo | 2.10 to 2.89 |
| V | 4.65 to 5.95 |
| Co | 10.55 to 11.64 |
| N | 0.018 to 0.195. |

12. The high-speed steel article of claim 1, wherein the following elements are present in the following concentration ranges in % by weight:

| | |
|---|---|
| C | 1.75 to 2.38 |
| Si | 0.35 to 0.75 |
| Mn | 0.28 to 0.54 |
| Cr | 3.56 to 4.25 |
| W | 13.90 to 14.95 |
| Mo | 2.10 to 2.89 |
| V | 4.65 to 5.95 |
| Co | 10.55 to 11.64 |
| N | 0.018 to 0.195. |

13. The high-speed steel article of claim 1, wherein at least one of the following elements is present in the following concentration ranges in % by weight:

| | |
|---|---|
| C | 1.69 to 2.29 |
| Si | 0.20 to 0.60 |

-continued

| | |
|---|---|
| Mn | 0.20 to 0.40 |
| Cr | 3.59 to 4.19 |
| W | 13.60 to 14.60 |
| Mo | 2.01 to 2.80 |
| V | 4.55 to 5.45 |
| Co | 10.40 to 11.50 |
| N | 0.02 to 0.1 |
| O | max 90 ppm. |

14. The high-speed steel article of claim 1, wherein the following elements are present in the following concentration ranges in % by weight:

| | |
|---|---|
| C | 1.69 to 2.29 |
| Si | 0.20 to 0.60 |
| Mn | 0.20 to 0.40 |
| Cr | 3.59 to 4.19 |
| W | 13.60 to 14.60 |
| Mo | 2.01 to 2.80 |
| V | 4.55 to 5.45 |
| Co | 10.40 to 11.50 |
| N | 0.02 to 0.1 |
| O | max 90 ppm. |

15. The high-speed steel article of claim 1, wherein the article is a tool.

16. The high-speed steel article of claim 14, wherein the article is a finishing tool.

17. The high-speed steel article of claim 12, wherein the article is a cutting tool.

18. The high-speed steel article of claim 14, wherein the article is a metal-cutting tool.

19. A process for making a high-speed steel article by powder metallurgy, wherein the steel has a content and configuration of nonmetallic inclusions corresponding to a K0 value according to DIN 50 602 of not higher than 3 and has the following chemical composition in percent by weight:

| | |
|---|---|
| carbon (C) | 1.51 to 2.5 |
| silicon (Si) | >0 to 0.8 |
| manganese (Mn) | >0 to 1.5 |
| chromium (Cr) | 3.5 to 4.5 |
| tungsten (W) | 13.3 to 15.3 |
| molybdenum (Mo) | 2.0 to 3.0 |
| vanadium (V) | 4.5 to 6.9 |
| cobalt (Co) | 10.05 to 12.0 |
| sulfur (S) | >0 to 0.52 |
| nitrogen (N) | >0 to 0.2 |
| oxygen (O) | max 100 ppm |

with a value of manganese minus sulfur (Mn−S) of at least 0.19, the remainder being iron and impurities related to the manufacturing process and accompanying elements, provided that the ratio of tungsten to molybdenum (W/Mo) is between 5.2 and 6.5 and the cobalt content is at most 70% of the value of (W+Mo), said process comprising dispersing a liquid stream of the steel with nitrogen into a metal powder and compacting the powder at high temperature under compression from all sides.

20. The process of claim 19, wherein the process further comprises hot working of the compacted metal powder.

21. The process of claim 20, wherein the hot working comprises forging.

22. The process of claim 20, wherein the article is a tool.

23. The process of claim 21, wherein the article is a cutting tool.

24. The process of claim 20, wherein the steel comprises the following elements in the following concentration ranges in % by weight:

| | |
|---|---|
| C | 1.75 to 2.38 |
| Si | 0.35 to 0.75 |
| Mn | 0.28 to 0.54 |
| Cr | 3.56 to 4.25 |
| W | 13.90 to 14.95 |
| Mo | 2.10 to 2.89 |
| V | 4.65 to 5.95 |
| Co | 10.55 to 11.64 |
| N | 0.018 to 0.195. |

25. The process of claim 22, wherein the steel comprises the following elements in the following concentration ranges in % by weight:

| | |
|---|---|
| C | 1.69 to 2.29 |
| Si | 0.20 to 0.60 |
| Mn | 0.20 to 0.40 |
| Cr | 3.59 to 4.19 |
| W | 13.60 to 14.60 |
| Mo | 2.01 to 2.80 |
| V | 4.55 to 5.45 |
| Co | 10.40 to 11.50 |
| N | 0.02 to 0.1 |
| O | max 90 ppm. |

26. A process for the high-speed machining of material parts, the process comprising machining the material parts with a powder metallurgy produced tool made of a high-speed steel, wherein the steel has a content and configuration of nonmetallic inclusions corresponding to a K0 value according to DIN 50 602 of not higher than 3 and has the following chemical composition in percent by weight:

| | |
|---|---|
| carbon (C) | 1.51 to 2.5 |
| silicon (Si) | >0 to 0.8 |
| manganese (Mn) | >0 to 1.5 |
| chromium (Cr) | 3.5 to 4.5 |
| tungsten (W) | 13.3 to 15.3 |
| molybdenum (Mo) | 2.0 to 3.0 |
| vanadium (V) | 4.5 to 6.9 |
| cobalt (Co) | 10.05 to 12.0 |
| sulfur (S) | >0 to 0.52 |
| nitrogen (N) | >0 to 0.2 |
| oxygen (O) | max 100 ppm |

with a value of manganese minus sulfur (Mn−S) of at least 0.19, the remainder being iron and impurities related to the manufacturing process and accompanying elements, provided that the ratio of tungsten to molybdenum (W/Mo) is between 5.2 and 6.5 and the cobalt content is at most 70% of the value of (W+Mo); and wherein the machining is conducted without lubricants.

27. The process of claim 26, wherein the steel comprises the following elements in the following concentration ranges in % by weight:

| | |
|---|---|
| C | 1.75 to 2.38 |
| Si | 0.35 to 0.75 |
| Mn | 0.28 to 0.54 |
| Cr | 3.56 to 4.25 |
| W | 13.90 to 14.95 |
| Mo | 2.10 to 2.89 |
| V | 4.65 to 5.95 |
| Co | 10.55 to 11.64 |
| N | 0.018 to 0.195. |

28. The process of claim 26, wherein the steel comprises the following elements in the following concentration ranges in % by weight:

| | |
|---|---|
| C | 1.69 to 2.29 |
| Si | 0.20 to 0.60 |
| Mn | 0.20 to 0.40 |
| Cr | 3.59 to 4.19 |
| W | 13.60 to14.60 |
| Mo | 2.01 to 2.80 |
| V | 4.55 to 5.45 |
| Co | 10.40 to 11.50 |
| N | 0.02 to 0.1 |
| O | max 90 ppm. |

29. The process of claim 26, wherein the parts are made of metal.

30. The process of claim 29, wherein the metal comprises a light metal.

31. The process of claim 29, wherein the metal is an alloy.

32. The process of claim 27, wherein the tool is a metal-cutting tool.

* * * * *